United States Patent [19]

Kunioka et al.

[11] 4,110,092

[45] Aug. 29, 1978

[54] METHOD OF APPARATUS FOR COOLING INNER SURFACE OF METAL PIPE

[75] Inventors: Kazuo Kunioka; Takao Noguchi, both of Yokohama; Hiroaki Sato, Tokyo, all of Japan

[73] Assignee: Nippon Kokan Kabushiki Kaisha, Tokyo, Japan

[21] Appl. No.: 762,954

[22] Filed: Jan. 26, 1977

[51] Int. Cl.[2] ..... F25B 17/02

[52] U.S. Cl. ..... 62/64; 134/167 C; 134/168 C; 148/20.6

[58] Field of Search ..... 62/64; 134/24, 167 C, 134/168 C; 266/129, 214; 148/20.6; 164/89, 443, 444

[56] References Cited

U.S. PATENT DOCUMENTS

| | | | |
|---|---|---|---|
| 2,735,794 | 2/1956 | Pletcher | 134/167 C |
| 3,339,373 | 9/1967 | Mobius et al. | 62/64 |
| 3,659,428 | 5/1972 | Kunioka et al. | 62/64 |
| 3,838,997 | 10/1974 | Becker et al. | 62/64 |
| 3,987,963 | 10/1976 | Pacht | 134/167 C |
| 3,994,310 | 11/1976 | Brandon | 134/167 C |

FOREIGN PATENT DOCUMENTS

| | | | |
|---|---|---|---|
| 784,585 | 10/1957 | United Kingdom | 134/167 C |

*Primary Examiner*—Ronald C. Capossela
*Attorney, Agent, or Firm*—Haseltine, Lake & Waters

[57] ABSTRACT

A cooling method and apparatus wherein in the process of continuously hardening a metal pipe by heating the metal pipe as it passes through a heating unit and then cooling the inner surface of the metal pipe, an annular cooling nozzle having a large number of nozzle openings is placed in the metal pipe, and the spray direction of jets of cooling medium from the nozzle openings is selected so as to maintain a dip angle of between 30° and 70° and a transversal angle of between 30° and 90° and either cooling water or a mixture of cooling water and compressed air is sprayed with a jet velocity of greater than 5 meters per second onto a large number of points on the circumference of the inner wall of the metal pipe.

6 Claims, 8 Drawing Figures

METHOD OF APPARATUS FOR COOLING INNER SURFACE OF METAL PIPE

BACKGROUND OF THE INVENTION

The present invention relates to a method and apparatus for cooling the inner surface of metal pipes.

In a known method of continuously hardening a metal pipe which comprises the steps of heating the metal pipe as it passes through a heating unit and then cooling the inner surface of the metal pipe, as shown in FIGS. 1(*a*) and 1(*b*), the cooling of the inner surface of a metal pipe 1 is accomplished by placing an annular cooling nozzle 2 within the metal pipe 1. A heating unit 3 for hardening puposes is arranged on the outer side of the metal pipe. A plurality of nozzle openings 4 are formed in the outer periphery of the annular nozzle 2 so that cooling water 6 supplied through a water supply duct 5 may be sprayed against the pipe inner surface. A disadvantage of this arrangement is that the water pressure at each of various points on the nozzle circumference differs from one another with the resulting difference in the rate of water flow from the nozzle openings 4 and moreover there are other detrimental factors such as retention of water on the pipe inner surface and the presence of water streams flowing opposite to the direction of travel of the pipe, thus giving rise to non-uniform cooling of the pipe, thereby causing non-uniform hardening of the pipe.

Although various methods including the method of quenching a metal pipe while rotating the pipe as it passes through the unit and the method of quenching a metal pipe by a rotating cooling nozzle have been proposed to overcome the foregoing deficiencies, when large diameter pipes are to be treated all of these conventional methods require a complicate equipment and thus satisfactory maintenance of such equipment is difficult.

SUMMARY OF THE INVENTION

It is the object of the present invention to provide an improved method and apparatus for cooling the inner surface of a metal pipe in which jets of fluid are directed to create a helical flow of fluid along the inner wall of a metal pipe, thereby overcoming the deficiencies of the prior art method and apparatus.

In accordance with the present invention, there are thus provided a method and apparatus wherein, in the process of continuously hardening a metal pipe by heating the metal pipe as it passes through a heating unit and then cooling the inner surface of the metal pipe, an annular cooling nozzle having a large number of nozzle openings is placed in the metal pipe, and the spray direction of jets of cooling medium from the nozzle openings is selected so as to maintain a dip angle in the range between 30° and 70° formed with the radial direction of the metal pipe on the side of the direction of travel of the metal pipe and a transversal angle of between 30° and 90° with respect to the radial direction of the metal pipe in the plane transversal to the direction of travel of the same and either cooling water or a mixture of cooling water and air is sprayed onto a large number of points on the circumference of the inner wall of the metal pipe.

DESCRIPTION OF THE PREFERRED EMBODIMENTS

The present invention will now be described in greater detail with reference to the illustrated embodiments.

Figure 1:
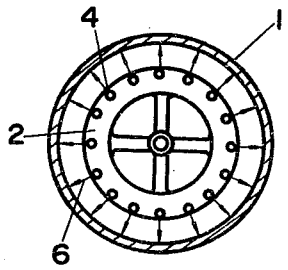
FIGS. 1(*a*) and 1(*b*) are respectively a side view of a conventional cooling apparatus and a sectional view along arrows I—I of FIG. 1(*a*).
Figure 1:
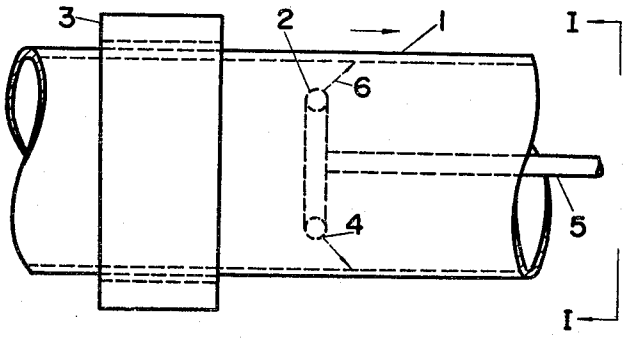
Figure 2:
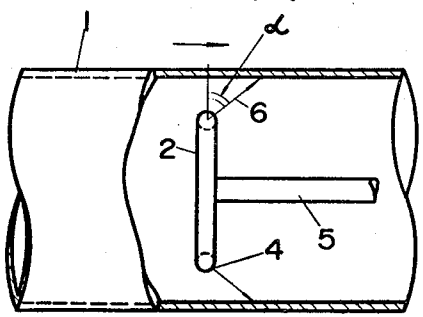
FIGS. 2(*a*) and 2(*b*) are respectively a cross-sectional view and a side view showing part in longitudinal cross-section of an embodiment of the present invention.
Figure 2:
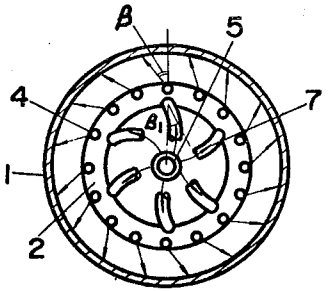

Referring first to FIGS. 2(*a*) and 2(*b*) showing a first embodiment of the invention, component parts which are the same with those shown in FIGS. 1(*a*) and 1(*b*) are designated by the same reference numerals, and the annular cooling nozzle 2 provided with a large number of the nozzle openings 4 is placed within the metal pipe 1 so that jets of fluid from the nozzle openings 4 are directed in such a manner that the velocity components of the jets in the plane of FIG. 2(*b*) have an angle $\alpha$ (hereinafter referred to as a dip angle) with respect to the radial direction of the annular cooling nozzle 2 on the side of the direction of travel of the metal pipe 1 and the velocity components of the jets in the plane of FIG. 2(*a*) have an angle $\beta$ (hereinafter referred to as a transversal angle) with respect to the radial direction of the annular cooling nozzle 2. Also arranged on the center line of the annular nozzle 2 is the water supply duct 5 which is connected to the nozzle 2 through a plurality of small supply ducts 7 and the small supply ducts 7 are connected to the nozzle 2 to cross the latter at a transversal angel $\beta_1$. A regulating valve is connected to the water supply duct 5 to adjust the flow rate and pressure of cooling fluid as desired, and cooling water 6 or cooling water uniformly mixed with compressed air is supplied to the nozzle 2 as desired.

Consequently, if cooling water or cooling water mixed with air and atomized is supplied under high pressure from the water supply duct 5, the cooling fluid flows into the cooling nozzle 2 at the transversal angle $\beta_1$ so that the fluid flows in a swirling stream within the annular nozzle 2 and it is then sprayed from the nozzle openings 4 while maintaining the dip angle $\alpha$ and the transversal angle $\beta$, thus creating a high-speed helical fluid flow along the inner wall of the metal pipe 1. It is required that the speed of jets of fluid is higher than 5 meters per second so that the jets of fluid which are directed upwardly can reach the inner wall of a metal pipe without fail in defiance of gravity and then positively create a helical fluid flow along the inner surface of the pipe. By spraying the cooling fluid at such jet velocity, it is possible to cool the inner surface of the pipe uniformly thus preventing the occurrence of any hard spots and any retention of the cooling fluid on the lower inner surface of the pipe, and also by suitably selecting the values of the dip and transversal angles, it is possible to prevent the occurrence of any opposing fluid flow against the direction of travel of the metal pipe, thereby ensuring more uniform cooling.

Figure 4:
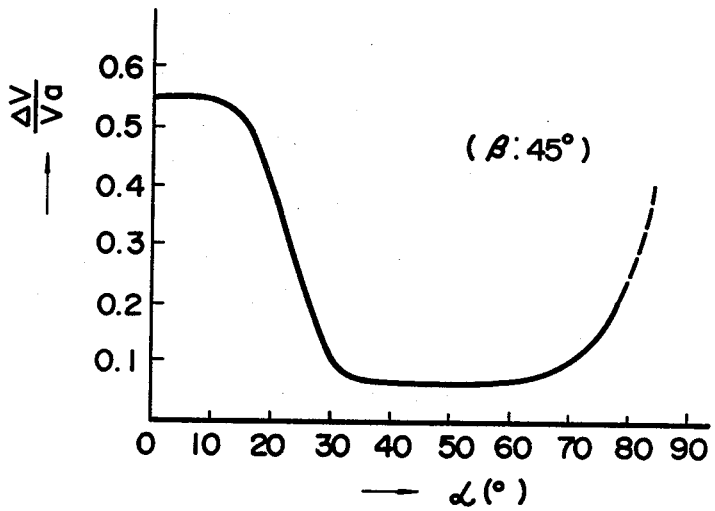
FIGS. 4 and 5 are graphs respectively showing the degree of uniformity of cooling in relation to the dip angle and the transversal angle, respectively.
Figure 5:
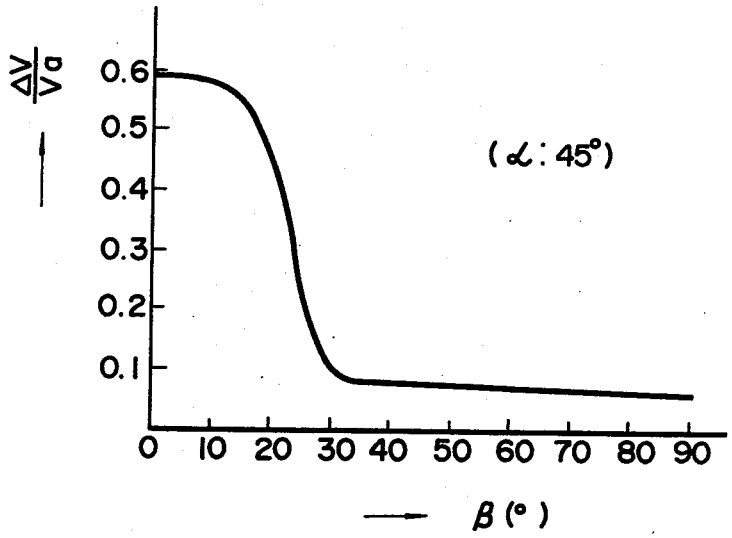

The time $t$ required for cooling from 800° C. to 400° C. (a temperature difference of 400° C.) was measured experimentally for each of a plurality of points on the circumference of metal pipes by setting thermocouples in the transversal center of the pipe wall. A cooling rate V at each of these points is given by $400/t$. degrees per second. Now assuming that $\Delta V$ represents the difference between the maximum cooling rate and the minimum cooling rate among the measured values of cooling rate at the points, and Va represents the average cooling rate, then the degree of uniformity of cooling is given by $\Delta V/Va$ and thus the smaller the value of $\Delta V/Va$ is, the higher the degree of uniformity becomes. In this experiment, the metal pipes were cooled with jets of cooling fluid sprayed at a high speed greater than 5 meters per second and the resulting values of cooling uniformity obtained by fixing the transversal angle $\beta$ at 45° and varying the dip angle $\alpha$ and by fixing the dip angle $\alpha$ at 45° and varying the transversal angle $\beta$ were dipicted in FIGS. 4 and 5, respectively. It will be seen from these experimental results that the dip angle $\alpha$ should preferably be selected to be in the range between 30° and 70° and the transversal angle $\beta$ should also preferably be selected to be in the range between 30° and 90°. Also, the value of $\beta_1$ should preferably be selected to be in the range between 30° and 60° from the standpoint of ensuring smooth flow of cooling water.

Figure 3A:
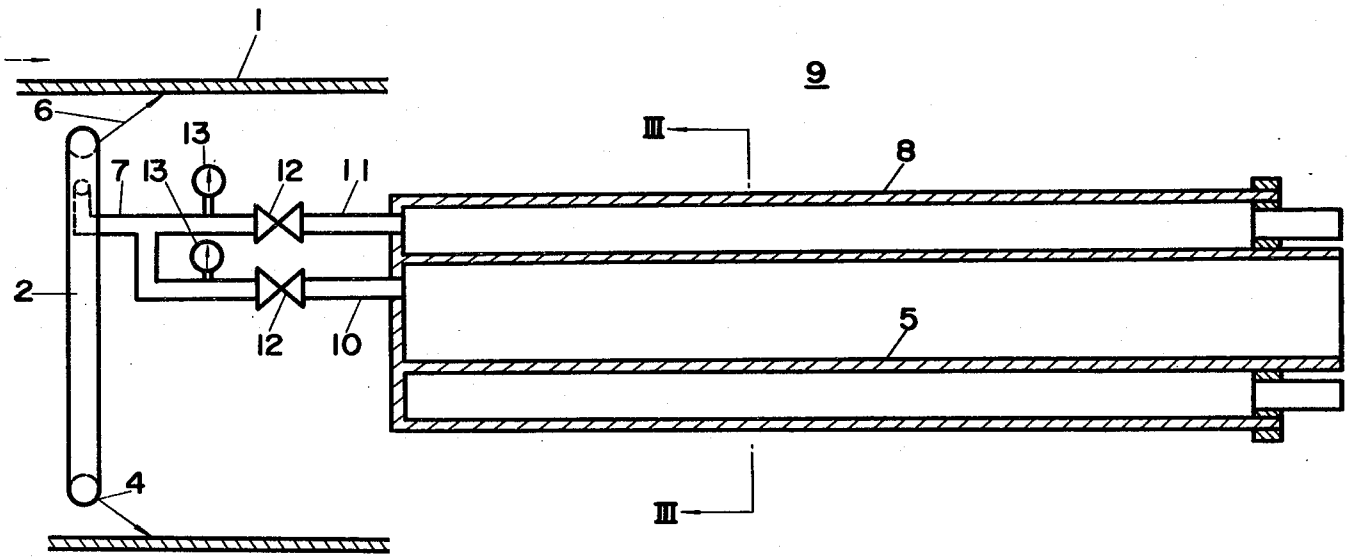
FIGS. 3(*a*) and 3(*b*) are respectively a longitudinal side sectional view of another embodiment of the invention together with an exemplary arrangement for supplying a mixture of cooling water and compressed air to a cooling nozzle, and a view in the direction of arrows III—III of FIG. 3(*a*).
Figure 3:
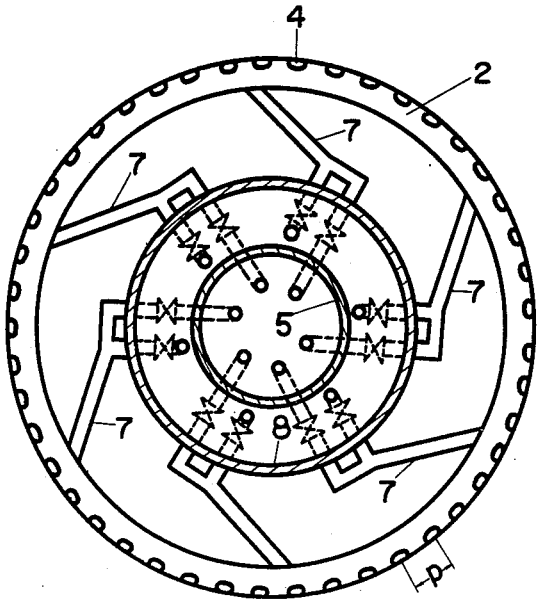

Next, a second embodiment of the invention wherein cooling water is mixed with compressed air and then supplied to a cooling nozzle will be described with reference to FIGS. 3(*a*) and 3(*b*). In this embodiment, a double duct 9 comprising a centrally located water supply duct 5 and a compressed air duct 8 arranged around the water supply duct 5, is centrally located in a metal pipe 1 and small water supply ducts 10 and small air ducts 11 are respectively extended from the ducts 5 and 8. Each of the small ducts 10 and 11 having a regulating valve 12 and a pressure gauge 13 mounted therein is connected to one of a plurality of small supply ducts 7 of the same type as used in the first embodiment. In this way, by propely adjusting the regulating valves while confirming the readings of the pressure gauges through observation, it is possible to supply suitably pressurized cooling water and compressed air, thus easily ensuring uniform spray pressure for jets of cooling fluid from the nozzle openings and easy control of the cooling rate.

It will thus be seen from the foregoing description that the present invention is useful in many respects, namely, uniform cooling effect is ensured by virtue of the fact that the inner surface of a metal pipe is uniformly covered by a helical flow of fluid created by high velocity jets of cooling fluid which are sprayed from a fixedly mounted cooling nozzle with predetermined dip and transversal angles, and moreover there is no problem of maintenance and service because of the non-use of any rotating mechanism.

What is claimed is:

1. An improved method of cooling the inner surface of a metal pipe whereby in the process of continuously hardening said metal pipe by heating said metal pipe while travelling and then cooling the inner surface of said metal pipe, including the steps of: cooling said metal pipe by spraying a cooling fluid from a large number of nozzle openings formed in an annular cooling nozzle disposed in said metal pipe, selecting a spray direction of said cooling fluid from said nozzle openings for maintaining a dip angle in the range between 30° and 70° formed with the radial direction of the metal pipe on the side of the direction of travel of said metal pipe, said improvement comprising: directing said nozzle openings at a transverse angle in the range between 30° and 90° with respect to the radial direction of said metal pipe in a plane transverse to the direction of said pipe travel and imparting to said cooling fluid a jet velocity of greater than 5 meters per second for impingement onto a large number of points on the circumference of the inner wall of said metal pipe.

2. A method according to claim 1, wherein said cooling fluid is water.

3. A method according to claim 1, wherein said cooling fluid is of air and water mixed within said annular nozzle.

4. An improved apparatus for cooling the inner surface of a metal pipe comprising a jet head adapted to be inserted into a pipe and to be moved along the axis thereof, said jet head comprising a plurality of jet nozzles distributed in circumferential direction, the axis of said nozzles cooperating with a plane being perpendicular to the axis of the jet head to form an angle of 30° to 70°, and comprising a feed line to supply cooling agent communicating with the jet nozzles, characterized in that the feed line is connected to the jet head through a plurality of thin supply lines, which merge into the jet head cooperating with a plane containing the merging point and the pipe axis to form an angle ($\beta_1$) being between 30° and 60°.

5. An apparatus according to claim 4, wherein said cooling fluid duct is a single duct for cooling water.

6. An apparatus according to claim 4, wherein said cooling fluid duct is of a double duct structure comprising a sooling water duct and a compressed air duct.

* * * * *